US005189396A

United States Patent [19]

Stobbe

[11] Patent Number: 5,189,396

[45] Date of Patent: Feb. 23, 1993

[54] ELECTRONIC SEAL

[76] Inventor: Anatoli Stobbe, Steinradweg 3, D-3013 Barsinghausen 2, Fed. Rep. of Germany

[21] Appl. No.: 711,653

[22] Filed: Jun. 6, 1991

[30] Foreign Application Priority Data

Jun. 16, 1990 [DE] Fed. Rep. of Germany ..... 4019265

[51] Int. Cl.[5] ..... G08B 13/06

[52] U.S. Cl. ..... 340/541; 340/540; 340/555; 340/568; 340/652; 368/10; 368/11

[58] Field of Search ..... 340/541, 568, 542, 540, 340/555, 652; 368/10, 11

[56] References Cited

U.S. PATENT DOCUMENTS 4,234,875 11/1980 Williams ..... 340/541
4,262,284 4/1981 Stieff et al. ..... 340/542
4,797,663 1/1989 Rios ..... 340/541

*Primary Examiner*—Glen R. Swann, III
*Attorney, Agent, or Firm*—Collard & Roe

[57] ABSTRACT

An electronic seal for a casing records the time of changes in the seal state. A sealing strip is fixed in the casing and is formed as a safety loop. A monitoring device is located in the casing and attached to the sealing strip. The monitoring device generates time values which are recorded when changes in the seal state occur.

25 Claims, 5 Drawing Sheets

ELECTRONIC SEAL

BACKGROUND OF THE INVENTION

1. Field of the Invention

The present invention relates to an electronic seal for a container or compartment. More particularly, it relates to a seal having a sealing strip and a monitoring device. When the monitoring device senses that the seal has been broken, it records information regarding the break in memory, which can be retrieved later.

2. The Prior Art

Seals according to the prior art are used on the locks of cargo compartments, ships' holds, crates or containers. These seals can detect whether or not a secured lock has been opened during transportation. One type of known seal includes a sealing wire and a lead seal connecting the ends of the wire. This seal has the disadvantage that an opened lock can easily be manipulated to simulate an undamaged seal. Another disadvantage is that in the case of an authorized opening of the seal, another lead seal has to be used since they are not reusable.

U.S. Pat. No. 4,766,419 discloses an electronic seal which avoids these two disadvantages associated with a lead seal. A random number generator, including a clock generator and a counter, is activated by opening the seal. Such activation produces a new number combination, which is displayed. In order to be able to produce the preceding number combination, it may be necessary to open and close the seal innumerable times, which would largely exclude the aforementioned tampering. As in the case of authorized opening, the new number combination is indicated in the forwarding papers, thus obviating the need to replace the seal following each opening.

However, this seal only provides information as to whether or not the secured lock may have been opened. The time and frequency of the seal break is not apparent. However, such information could clarify the question as to whether a break was intentional, improper or accidental.

SUMMARY OF THE INVENTION

It is therefore an object of the present invention to eliminate the aforementioned drawbacks of the prior art and to provide an electronic seal which provides information on the time and duration of seal openings.

It is a further object of the present invention to provide such a device which protects the seal data from unauthorized access.

These and other related objects are attained according to the invention by an electronic seal having a sealing strip and a monitoring device, including an opening sensor, a clock generator, a counter, a memory and a power source.

In a novel manner, logistic data in addition to the actual time data concerning changes to the seal state can be stored in the memory. Such data can, e.g., be the starting time, i.e., the time at which sealing took place, the time zone involved, the loading point, the destination, country, owners, the forwarding agent for the sealed goods, the transportation means, etc. This information provides both the recipient and Customs with reliable information which have hitherto not been available, or only available with very considerable difficulty.

In addition, the sealing strip is surprisingly incorporated into the safety loop monitoring the seal state.

Thus, if the sealing strip is forcibly broken open and separated, it is detected by the electronic seal and the time is recorded.

Advantageously, during each interruption of the safety loop, the actual count of the counter timed by the clock generator is entered in the memory. Thus, the memory content makes it possible to associate a relative time with the seal breaks. The indication of a relative time, compared with an absolute time indication, offers the advantage that it is possible to account for different time zones, in which the seal was closed, checked, or broken open.

Advantageously, the sealing strip is constructed as an electrical conductor or light guide, e.g., optic fiber. At the ends of the signal path are a signal generator and a signal receiver. The signals conveyed over the signal strip can be coded and/or modulated.

The construction of the sealing strip as an optic fiber provides greater security against breach by possible bridging of the strip. In addition, interruptions by corrosion are excluded.

The construction as an electrical conductor incorporates the entire sealing wire into the safety loop. Any problems caused by corrosion can be reduced by an appropriate choice of material, e.g., the use of high-grade steel. The positioning of a signal generator at the signal wire inlet and a signal receiver at its outlet also permit the aforementioned coding or modulation of the signal transferred via the signal strip.

The count of the counter timed by the clock generator is constantly modified, so that when the actual count is transferred into the memory a relative time indication is stored. All of the stored data is linked together, not overwritten, so that all information is retained. Thus, from the number of memory entries it is possible to determine the number of seal breaks.

Through the data transmission means it is possible to assess far more details than can be simultaneously displayed on the limited surface of an integrated display. It is also possible to prevent the direct display of relevant data on an integrated display and to only allow access through the corresponding external equipment for the data transmission means.

According to a further development the memory is constructed as a recordable, non-volatile memory. Preferably one area is then re-recordable, e.g., erasable memory, whilst another area can only be recorded once, e.g., permanent memory. This makes it possible to permanently store the data. Data will not be lost by a drop in the operating voltage. It is therefore ensured that the data originally entered at the loading point and also the counter data which have been stored when there was an adequate operating voltage, can still be polled if the vehicle arrives at the destination after a considerable delay.

In a preferred embodiment the permanent memory contains storage locations for permanent data. The erasable memory contains storage locations for the actual count of the counter timed by the clock generator and also storage locations for logistic data such as the starting time, time zone, loading point, destination, country, owners, forwarding agent and transportation means.

The permanent memory can store data suitable for identification and which cannot subsequently be changed. Even if all the erasable memory storage locations are accidentally or intentionally erased or overwritten, e.g., it is still possible to establish the seal owners.

The erasable memory offers sufficient capacity to store a large number of information items, corresponding to a substantially unbroken chain representing the transportation route with openings and closings. The stored information and the corresponding information in the forwarding papers makes it possible to eliminate errors and detect tampering.

According to a preferred embodiment the opening sensor includes a comparator with two inputs. One input receives the signals from the counter directly and the other input receives the signals from the counter via a signal path passing through the closed sealing wire. The comparator output is connected to a control logic element.

Thus, a change of state is produced whenever the signal path passing through the sealing wire is opened or closed. It is unimportant whether the sealing wire is removed from its fixture or is separated or cut through at any point. Thus, an opening of the seal is clearly detectable and is in each case stored with a time related to the starting time.

In addition, the comparator output can be connected to a switch, which applies operating voltage to the control logic and memory in the case of state changes in the comparator. This feature disconnects the power source, during where no state change takes place, thus the memory and the control logic can be switched off.

Preferably a voltage monitoring circuit is provided, so that when the operating voltage drops below a threshold value, a "low battery signal" is entered into one of the storage locations of the memory.

Thus, if the operating voltage is no longer adequate for operation, this makes it possible to give the relative time as from which the storage of data could become unreliable or up to when a completely satisfactory determination of the opening and closing processes of the seal can be assumed.

According to a possible variant the casing contains a display connected directly to the memory or connected thereto via the control logic for displaying the memory content and/or a "seal opened" signal.

Said display can be in the form of a digital or alphanumeric display, which completely or partly displays the stored data, or can merely be a function or error control, which responds, e.g., to the opening of the seal.

According to a further preferred embodiment, the data transmission means includes a unit integrated into the casing and an external unit, each of which contains a transmitter and a receiver allowing for bidirectional data flow.

Such a construction of the data transmission means permits a much more comprehensive evaluation of the stored data than would be possible with a display integrated into the casing. It is also then possible to centrally and automatically determine and further process the data, which avoids possible errors caused by reading errors and manual transmission errors of the read data. It is also advantageous from the security aspect to maintain secrecy regarding the detected data and to only make same available to authorized personnel having the supplementary equipment required for displaying the data.

The bidirectionality also makes it possible to input data into the memory from the outside without mechanical interaction, such as is required at the start of transportation. In addition, the transmitters and receivers of the two units can be connected in a contactless manner, preferably electromagnetically.

Thus, the circuit elements integrated into the casing can be hermetically sealed from the outside. This largely excludes any electrical damage to the subassemblies due to tampering. Transmission errors due to dirty or damaged contacts are also avoided.

Preferably, the unit integrated into the casing includes an energy receiver with an energy memory and the external unit includes an energy transmitter.

The electrical energy required for reading and writing data into and out of the memory can consequently be completely transmitted from the outside. This firstly protects the incorporated energy source necessary for operating the clock generator and the counter and also allows data to be read out if the incorporated energy source is defective or exhausted.

In a further embodiment, both the transmitter, the receiver and the energy receiver of the unit integrated into the casing and also the transmitter, receiver and energy transmitter of the external unit have a common resonant circuit.

This solution offers constructional advantages, which are very significant with regard to reduced casing size and low manufacturing costs. It also ensures that energy transmission and data transmission in both directions are always possible together. Appropriately, the external unit incorporates a further memory, a display and an input device.

The data read-out of the memory can then be intermediately stored and secured for further evaluation. The data to be entered can be prepared ahead of time and then transferred into the memory in a short amount of time and without any transmission errors.

From the mechanical standpoint, according to a variant the sealing strip is locked at one side into the casing and its other side can be fixed in a locking device. Thus, the sealing strip always remains connected to the casing and cannot be lost when the seal is opened.

In another embodiment, the sealing strip can be fixed at both sides in a common locking device. This offers the advantage that said strip can easily be replaced in the case of a break or a corrosion.

Appropriately, the locking device has a pivotable eccentric cam and a detent engaging in the latter in the locking position. The eccentric cam then fulfills two functions. The first is to mechanically fix the sealing strip, so that it does not slide out. The other creates a pressing effect against a contact for producing the closed signal path. The eccentric cam is only freed for operation if the detent is previously pressed in. This provides security against an unintentional operation of the eccentric cam.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
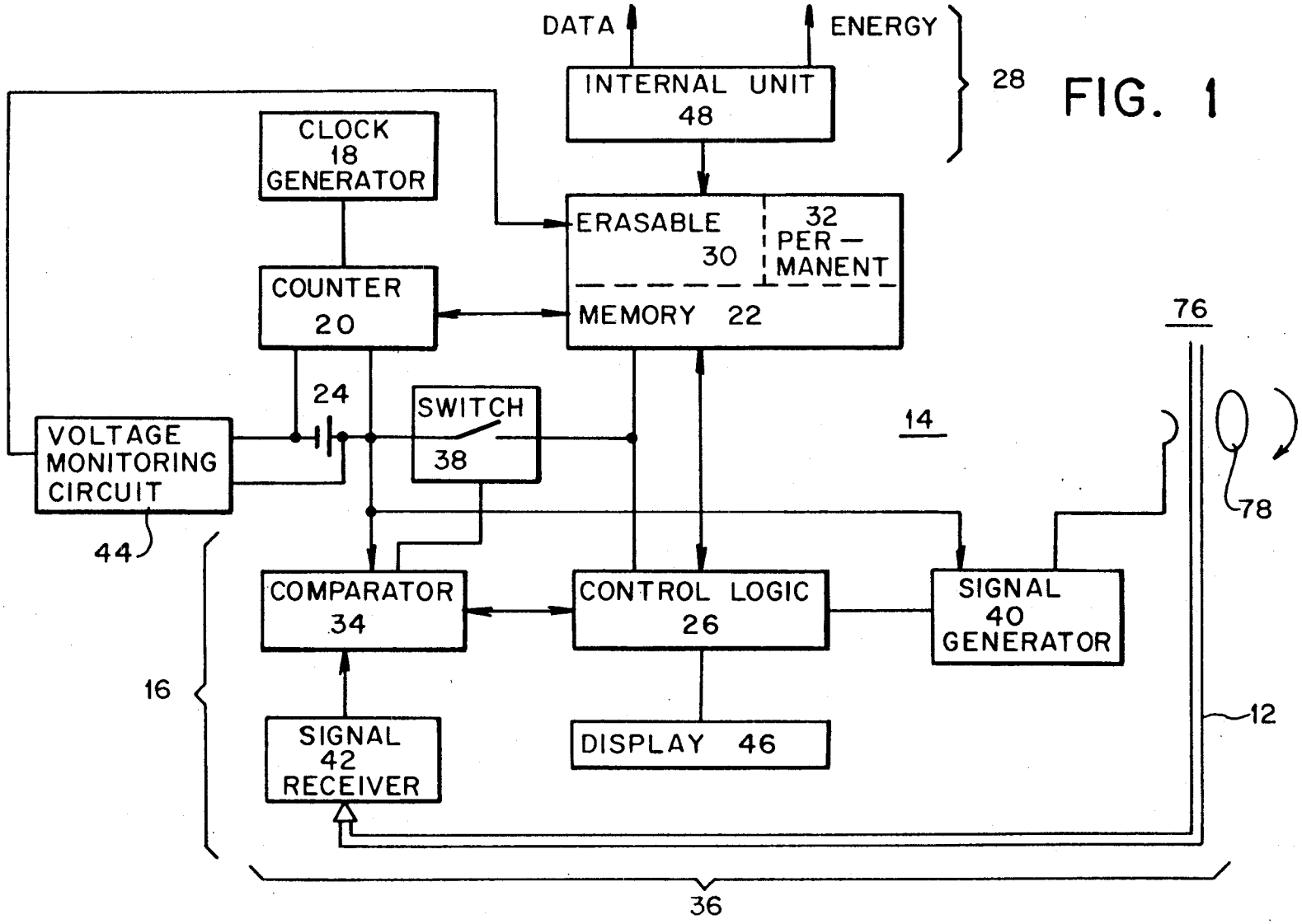
FIG. 1 is a block circuit diagram of an electronic seal embodying the present invention.

Turning now in detail to the drawings, in FIG. 1 there is illustrated a block circuit diagram embodying the present invention with an electronic seal. The seal includes a sealing strip 12, which is anchored in a casing (not shown for reasons of clarity) and a monitoring means 14 housed in the same casing.

Monitoring means 14 includes an opening sensor 16, a clock generator 18, a counter 20, a memory 22 and a power source 24. Opening sensor 16 includes a comparator 34, whose one input receives signals from counter 20 directly and whose other input receives signals from counter 20 via a signal path 36 passing through closed sealing strip 12.

Memory 22 contains several storage locations into which can be successively entered the actual count of counter 20 timed by clock generator 18 whenever opening sensor 16 responds. The stored data can be subsequently read out by means of a data transmission means 28, which is connected to memory 22.

Memory 22 is constructed as a non-volatile memory, i.e., it does not require power to maintain information stored there. It has an erasable memory 30 which can be reused, also a permanent memory 32 which can be encoded only once, but read many times. Apart from storage locations for the actual count of counter 20, erasable memory 30 also has storage locations for logistic data. Such logistic data can, e.g., be the starting time, the time zone, the loading point, the destination, the country, the owners, the forwarding agents or the transportation means. Permanent memory 32 is intended to store invariable characteristic data such as, e.g., the factory number and the original owners.

Another output from comparator 34 is connected to switch 38 which, in the case of state changes comparator 34 applies operating voltage to a control logic 26 and memory 22. At other times when it is not necessary to access memory 22, switch 38 disconnects power source 24 from memory 22 and control logic 26.

A voltage monitoring circuit 44 ensures that when the operating voltage drops below a threshold value, a "low battery signal" is entered in one of the storage locations of memory 22.

Sealing strip 12 can be constructed as an electrical conductor or as a light guide, e.g., optic fiber. A signal generator 40 and a signal receiver 42 also belong to signal path 36 of which sealing wire 12 forms part.

One end of the sealing strip or wire can be fixed in a locking device 76 by means of an eccentric cam 78 and thus comes into contact with an output terminal of signal generator 40. If sealing strip 12 is an electrical conductor, it can be a simple metallic contact. However, in the case of an optic fiber, a corresponding light source is required.

In addition, a display or indicating means 46 is connected directly to memory 22 or to control logic 26, which can be constructed as a simple indicator, e.g., for a "seal opened" signal, or in the case of a digital or alphanumeric display, possibility as a memory content display.

Data transmission means 28 allows data in memory 22 to be polled from the outside and subsequently centrally evaluated. Data transmission means 28 also permits a recording of, e.g., the logistic data in memory 22. A unit 48 integrated into the casing and an external unit (not shown for reasons of clarity) produces a data transmission line which forms part of data transmission means 28.

The circuit described up to now functions as follows. After sealing strip 12 of the electronic seal has been passed through the rings of the lock of a container to be sealed, it is locked in the locking device 76 by means of eccentric cam 78, so that signal path 36 is closed. Corresponding logistic data are recorded in memory 22 by means of an external unit and the seal is then activated.

Clock generator 18 now advances counter 20 from a starting value and the count of counter 20 is evaluated by comparator 34. For as long as signal path 36 is closed, comparator 34 receives the value of counter 20 directly and also receives the value via signal generator 40, sealing strip 12 and signal receiver 42. For as long as the values at the two comparator inputs coincide, there is no change at the comparator output. Thus, no data is recorded in memory 22.

If signal path 36 is interrupted, either because locking device 76 has been opened or because sealing strip 12 has been damaged, this is detected by comparator 34 due to different input values being received. Comparator 34 directs the actual value of counter 20 to be recorded in memory 22 by means of control logic 26. This is a relative time indication which, as a result of the logistic data in memory 22, can subsequently be easily converted into an absolute time indication.

Prior to the actual recording process switch 38 is activated, which applies operating voltage to memory 22 and control logic 26.

If sealing strip 12 is locked again after a certain time and therefore signal path 36 closed, this change of state can also be recorded in memory 22. It would then be possible to record both the seal opening time and the seal closing time.

If the container is considerably delayed for any reason, power source 24 which must constantly power clock generator 18, counter 20 and comparator 34 may become exhausted. In order to eliminate any uncertainty as to whether the data recorded is valid or invalid when the operating voltage drops below a threshold value, voltage monitoring circuit 44 ensures that a low battery signal is entered in memory 22. It is then clear what time the battery became discharged. The previously stored data can therefore be considered valid, whereas subsequently stored data may be inaccurate.

When the container with its electronic seal reaches its destination, the stored data can provide an itinerary which contains precise information on the time and duration of the opening of the electronic seal.

After polling the data the electronic seal can be reused and the hitherto stored data can be overwritten by other data.

Figure 2:
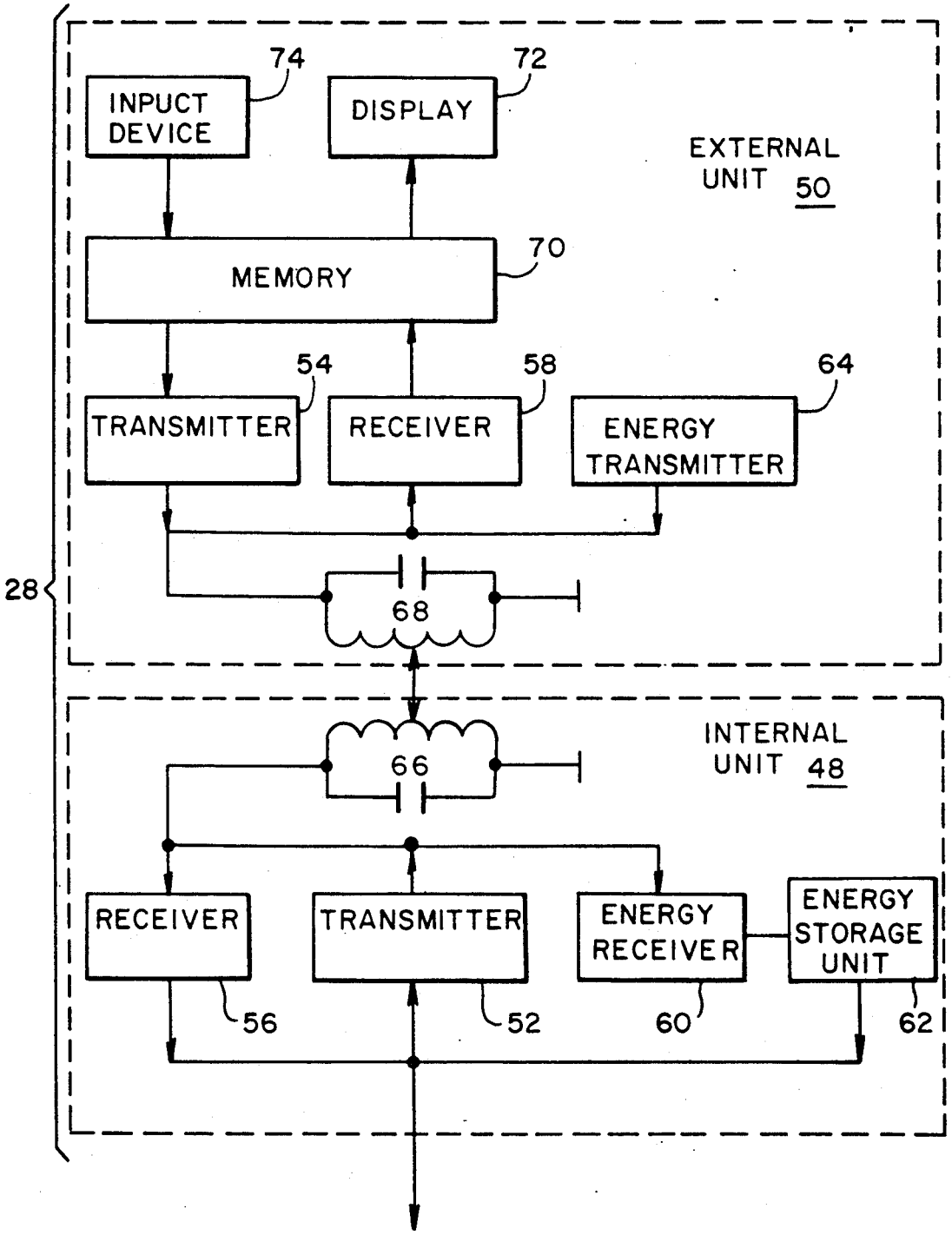
FIG. 2 is a block circuit diagram of the data transmission means for the electronic seal.

A suitable data transmission means for the electronic seal is shown in the block circuit diagram of FIG. 2.

Data transmission means 28 includes internal unit 48 integrated into the electronic seal casing, in the manner shown in FIG. 1 and an external unit 50. In order to permit a bidirectional data flow, there are both transmitters and receivers in the two units 48 and 50. Unit 48 has a transmitter 52 and a receiver 56 for both data and instructions. Correspondingly, external unit 50 contains a transmitter 54 and a receiver 58. The particular transmitters 52/54 and receivers 56/58 of the two units 48 and 50 are contactless and can be electromagnetically connected in the present case.

Apart from the hardware for transmission of data and instructions unit 48 also contains an energy receiver 60 with an energy storage unit 62. An energy transmitter 64 in external unit 50 provides power to energy receiver 60 and energy storage unit 62. Energy storage unit 62 then provides the energy necessary for reading data into or out of memory 22.

For transmission purposes a common resonant circuit is provided. A resonant circuit 66 is located in unit 48 and a resonant circuit 68 is located in unit 50. Energy transmitter 64 is operatively connected to resonant circuit 68 and energy receiver 60 is operatively connected to resonant circuit 66. Energy receiver 60 is connected in series with energy store 62, which provides voltage stabilization and which could also be used in principle for charging power source 24 in FIG. 1.

External unit 50 comprises a further memory 70, a display 72 and an input device 74. Display 72 can display, and evaluate all data transferred from memory 22 into further memory 70. By means of input device 74 it is possible to prepare data to be inputed which are then filed in memory 70, so that they are immediately available to transfer to a just closed seal. As a result of transmission means 28 there is really no need for display 46 on the casing. Alternatively, the casing display could be limited to a few values, such as, e.g., an opening indicator for the sealing wire. The stored data is then secure and can only be accessed by persons having a corresponding external unit 50. The data transmission between units 48 and 50 then takes place when resonant circuits 66 and 68 are adequately coupled together.

Figure 4:
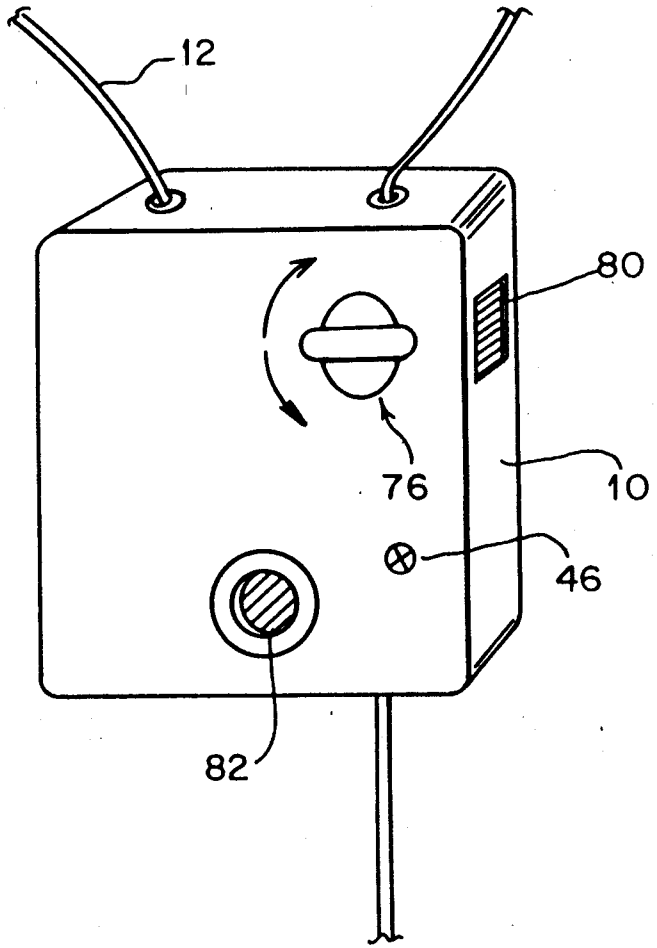
FIG. 4 is a front elevational view of an electronic seal casing with a sealing strip anchored on one side.
Figure 3:
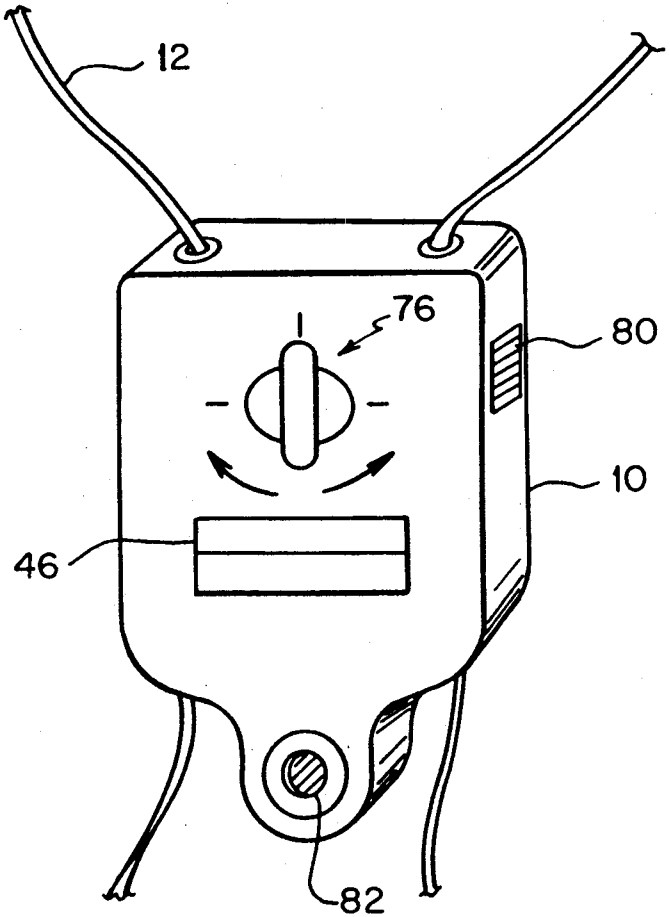
FIG. 3 is a front elevational view of the electronic seal casing with a display or indicator.
Figure 5:
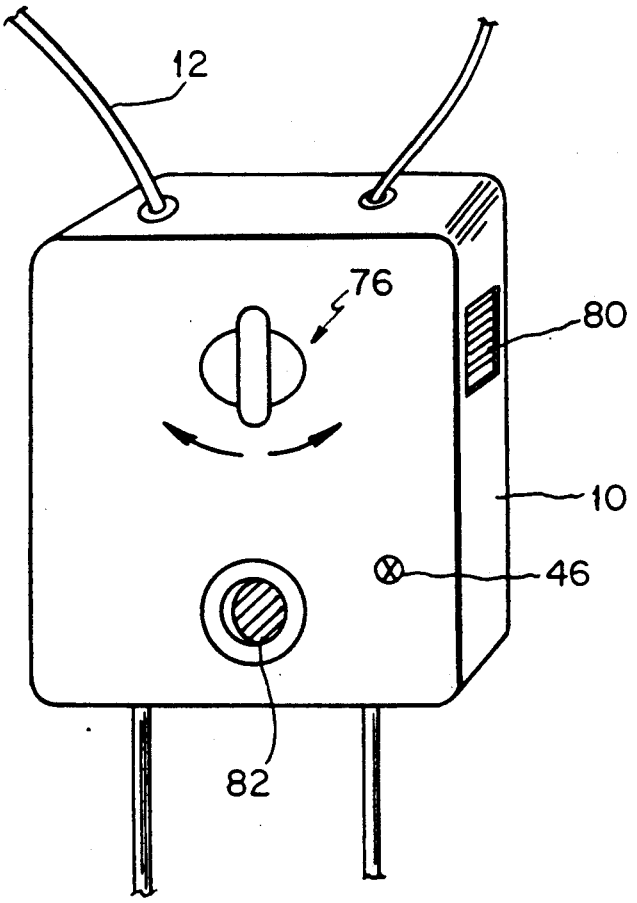
FIG. 5 is a front elevational view of an electronic seal casing with a sealing strip locked at both sides.

FIGS. 3 to 5 show different constructional possibilities for the electronic seal.

The electronic seal circuit shown in FIG. 1 is located in casing 10, which has openings for sealing strip 12. The sealing strip can be fixed within the casing by means of locking device 76. If the operating lever of locking device 76 is transferred into a closed position, a detent 80 engages and prevents any accidental turning back into the open position. The locking device 76 can only be reopened after operating detent 80.

As a result of the represented construction size of casing 10, the electronic seal can be easily attached to the lock of a container in the same way as a lead seal. No special fastening is required.

However, if such a fastening is provided, there is a fastening hole 82, through which can be passed a bolt, which is then screwed, e.g., on the other side of a container door.

The electronic seal construction shown in FIG. 3 has a display 46 integrated into casing 10. This display 46 can display digital and alphanumeric data concerning the memory content and can also provide a function and status indication.

A detailed or complicated display is not used in the constructions of FIGS. 4 and 5. There is in fact only an indicator 46, e.g., in the form of a light-emitting diode (LED), which merely indicates as to whether or not the seal was opened after activation. Different constructions are given in FIGS. 4 and 5 for the fastening of sealing strip 12 to casing 10. In FIG. 4 one end of sealing strip 12 is firmly anchored in the casing and only the other end is locked by means of locking device 76. This offers the advantage that sealing strip 12 is always connected to casing 10, so that it cannot be lost.

In the construction according to FIG. 5 both sides of sealing strip 12 are fixed in casing 10 by means of locking device 76. This construction offers the advantage that sealing strip 12 can be easily replaced in the case of damage.

Figure 6:
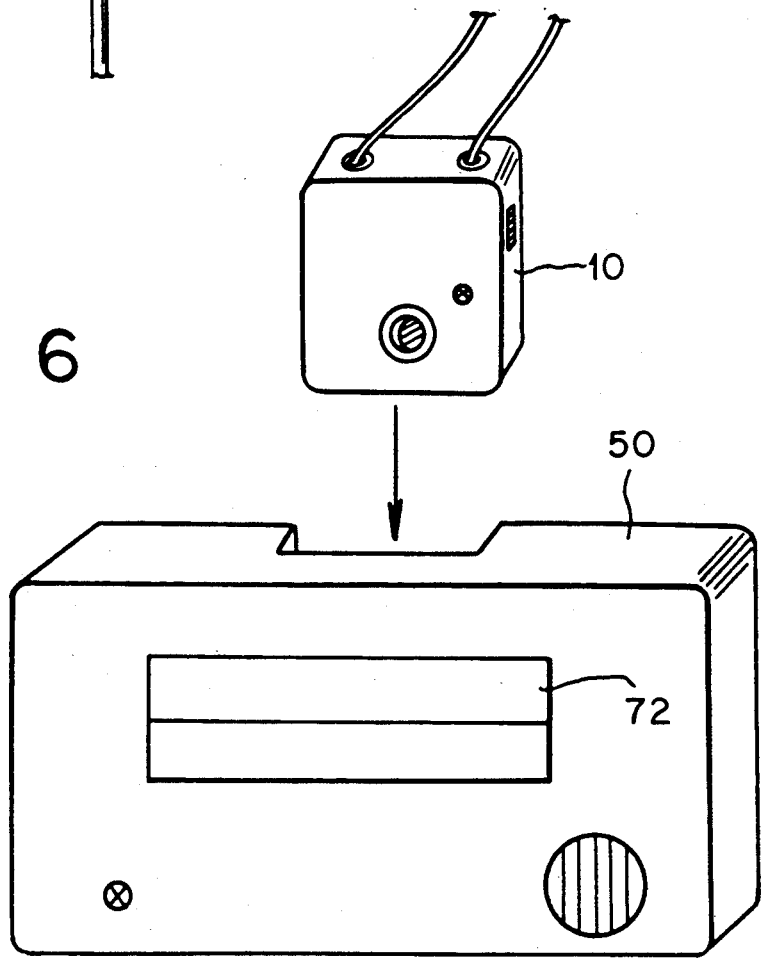
FIG. 6 is a front elevational view of an electronic seal casing and an external unit.

FIG. 6 shows a view of an electronic seal in conjunction with an external unit. The external unit 50 is provided with a display 72, which makes it possible to display the data stored in memory 22 of the electronic seal. The arrow passing out of the electronic seal casing 10 indicates a groove within the casing of external unit 50 into which can be introduced the electronic seal for the better coupling of the resonant circuits. In the construction according to FIG. 6 only a limited data exchange is possible. This more particularly applies to the data entry possibility.

Figure 7:
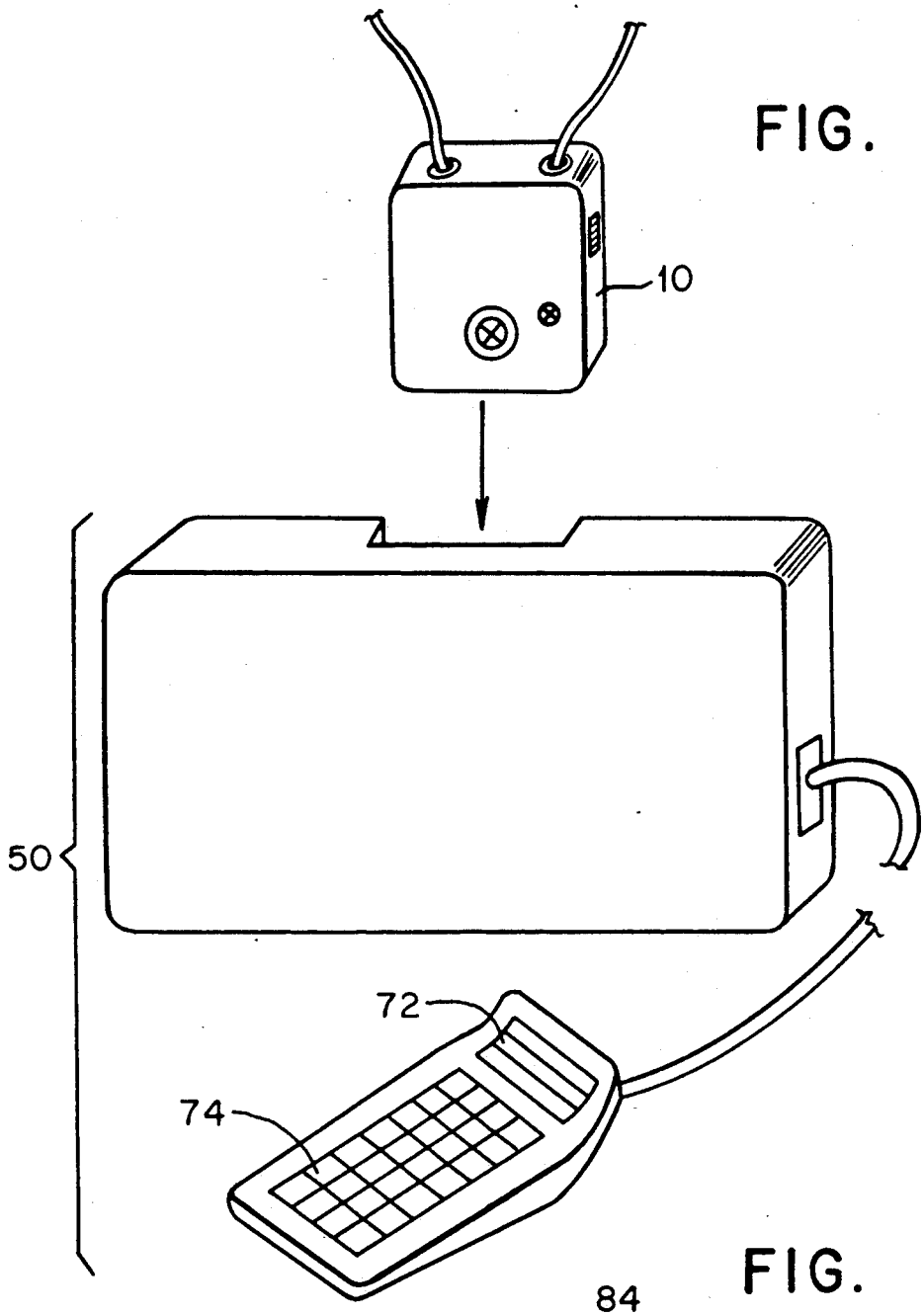
FIG. 7 is a front elevational view of an electronic seal casing and an external unit, which has an input/output device.

However, FIG. 7 shows a casing of an electronic seal in conjunction with an external unit, which has an offset input and output device. The casing with the slot, into which electronic seal casing 10 is introduced for data transmission purposes, only serves as a read-write head. The storage, display, evaluation and entry of data take place by means of an external computer, whereof only display 72 and input device 74 are shown here.

Figure 8:
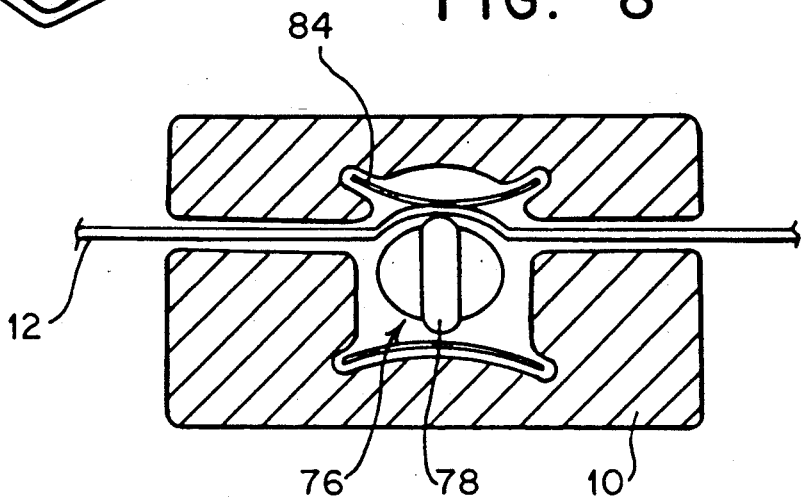
FIG. 8 is a cross-sectional view through a locking device.

Finally, FIG. 8 shows a longitudinal section through locking device 76. The latter has pivotable eccentric cam 78, which in the locking position presses inserted sealing strip 12 against a contact spring 84 and in the case of an electrical conductor produces an electrical contact between sealing strip 12 and spring 84. In a position pivoted by 90° eccentric cam 78 releases the insertion channel, so that sealing strip 12 can be drawn out of the slot.

While only several embodiments of the present invention have been shown and described, it is to be understood that many changes and modifications may be made thereunto without departing from the spirit and scope of the invention as defined in the appended claims.

What is claimed is:

1. An electronic seal for recording the time of changes in the seal state and storing logistics data comprising:

a sealing strip fixed in a casing and formed as a safety loop; and a monitoring device located in the casing and attached to said sealing strip for monitoring the seal state, said monitoring device including i. a power source operatively connected to said monitoring device;

ii. an opening sensor;

iii. a clock generator;

iv. a counter clocked by said clock generator for generating a time value; and v. a memory containing starting time, time zone, loading point, destination, country, owners, forwarding agents and transportation information, said opening sensor detecting changes in the seal state and storing an associated time value in said memory, said monitoring device generating time values at periodic intervals, detecting changes in the seal state and recording time values associated with changes in the seal state so that the time and duration of seal openings as well as the logistics of the casing, determines the location of the casing at the time of a seal opening.

2. The electronic seal according to claim 1, wherein said opening sensor detects interruptions of the safety loop and stores the actual count of said counter clocked by said clock generator in said memory.

3. The electronic seal according to claim 2, additionally comprising a control logic, and several storage locations in said memory, said control logic capable of successively accessing said storage locations for storing the actual count of said counter in response to each detected change in the seal state by said opening sensor.

4. The electronic seal according to claim 3, wherein said memory is a non-volatile memory with at least one permanent storage location and at least one erasable storage location.

5. The electronic seal according to claim 4, wherein said permanent storage location contains permanent data and said erasable storage location contains locations for the actual count of the counter, and logistics data including starting time, time zone, loading point, destination, country, owners, forwarding agents and transportation means.

6. The electronic seal according to claim 1, wherein said sealing strip is constructed as an electrical conductor and forms a signal path with a signal generator and a signal receiver at either end of said signal path.

7. The electronic seal according to claim 1, wherein said sealing strip is constructed as an optical fiber and forms a signal path with a signal generator and a signal receiver at either end of said signal path.

8. The electronic seal according to claim 1, wherein signals transmitted along said sealing strip are coded signals.

9. The electronic seal according to claim 1, wherein signals transmitted along said sealing strip are modulated signals.

10. An electronic seal for recording the time of changes of the seal state comprising:

a sealing strip fixed in a casing and formed as a safety loop;

a monitoring device located in the casing and attached to said sealing strip for monitoring the seal state, said monitoring device including i. a power source operatively connected to said monitoring device;

ii. an opening sensor for detecting changes in the seal state in the form of interruptions of the safety loop;

iii. a clock generator;

iv. a counter clocked by said clock generator for generating a time values at periodic intervals; and v. a non-volatile memory having several storage locations including at least one permanent storage location containing permanent data and at least one erasable storage location containing the actual count of the counter, and logistics data including starting time, time zone, loading point, destination, country, owners, forwarding agents and transportation means; and a control logic capable of successively accessing said erasable storage locations for storing the actual count of said counter in response to each detected change in the seal state by said opening sensor, wherein said opening sensor includes a comparator with two inputs and an output, said first input is connected directly to said counter, said second input is connected to said sealing strip which is connected to said counter, said output is connected to said control logic which stores the actual count when said comparator detects a change in said second input, whereby the stored actual count, together with the logistics data, determines the location of the casing at the time of a seal opening.

11. The electronic seal according to claim 10, wherein said comparator further includes a second output configured as connecting means for removably connecting said power supply to said control logic and said memory.

12. The electronic seal according to claim 11, additionally comprising voltage monitoring means connected to said power source for storing a value in said erasable storage location when said power supply voltage drops below a predetermined value.

13. The electronic seal according to claim 12, additionally comprising display means integrated into the casing and connected to said memory for displaying said memory contents.

14. The electronic seal according to claim 13, wherein said display means is connected to said control logic.

15. The electronic seal according to claim 14, wherein said display means is capable of providing a display indicating a seal opening.

16. The electronic seal according to claim 15, additionally comprising data transmission means connected to said memory and capable of accessing said memory contents.

17. The electronic seal according to claim 16, additionally comprising an external unit which includes a first transmitter and a first receiver, said data transmission means including a second transmitter and a second receiver, said transmitters and receivers allowing input and output of said memory contents.

18. The electronic seal according to claim 17 wherein said external unit and said data transmission means are connected by electromagnetic means.

19. The electronic seal according to claim 18, wherein said external unit includes energy transmission means, said data transmission means includes energy receiving means and energy storage means.

20. The electronic seal according to claim 19, wherein said external unit and said data transmission means have a common resonant circuit.

21. The electronic seal according to claim 20, wherein said external unit additionally comprises an external memory, external display means, and an external input means.

22. An electronic seal for recording the time of changes of the seal state comprising:

a sealing strip fixed in a casing and formed as a safety loop;

a monitoring device located in the casing and attached to said sealing strip for monitoring the seal state, said monitoring device including a power source operatively connected to said monitoring device, an opening sensor, a clock generator, a counter clocked by said clock generator for generating a time value; and a memory containing logistics data including starting time, time zone, loading point, destination, country, owners, forwarding agents and transportation information, said opening sensor detecting changes in the seal state and storing an associated time value in said memory; and a locking device having a pivotable eccentric cam and a detent for releasably engaging said cam in a locked position for attaching said sealing strip to said locking device, said monitoring device generating time values at periodic intervals, detecting changes in the seal state and recording a time value associated with changes in the seal state sot hat the time and duration of seal openings can be known and, employing the logistics data, the location of the casing at the time of a seal opening can be determined.

23. The electronic seal according to claim 22, wherein said sealing strip has two ends, one end being attached to the casing and the other end fixed in said locking device.

24. The electronic seal according to claim 22, wherein said sealing strip has two ends, both ends being fixed in said locking device.

25. An electronic seal for recording the time of changes of the seal state and storing logistics data comprising:

a sealing strip fixed in a casing and formed as a safety loop;

a control logic; and a monitoring device located in the casing and attached to said sealing strip for monitoring the seal state, said monitoring device including i. a power source operatively connected to said monitoring device;

ii. an opening sensor;

iii. a clock generator;

iv. a counter clocked by said clock generator for generating a time values; and v. a memory containing starting time, time zone, loading point, destination, country, owners, forwarding agents and transportation information, said opening sensor detecting interruptions of the safety loop and storing the actual count of said counter in said memory, said monitoring device generating time values at periodic intervals, detecting changes in the seal state and recording a time value associated with changes in the seal state so that the time and duration of seal openings as well as the logistics of the casing, determines the location of the casing at the time of a seal opening.

* * * * *